United States Patent [19]

Heitmanek

[11] Patent Number: 4,894,262

[45] Date of Patent: Jan. 16, 1990

[54] LUMBER END SEALING MACHINE

[75] Inventor: Thomas A. Heitmanek, Portland, Oreg.

[73] Assignee: API, Inc., Eugene, Oreg.

[21] Appl. No.: 261,740

[22] Filed: Oct. 24, 1988

[51] Int. Cl.[4] ..... B05D 1/02

[52] U.S. Cl. ..... 427/393; 118/680; 118/686; 118/687; 118/314; 118/323; 118/326; 427/393; 427/424

[58] Field of Search ..... 118/680, 686, 687, 314, 118/323, 326; 427/393, 424

[56] References Cited

U.S. PATENT DOCUMENTS

| | | | |
|---|---|---|---|
| 1,966,093 | 7/1934 | Griffen | 91/45 |
| 2,041,765 | 5/1936 | Howell | 118/314 |
| 2,246,502 | 6/1941 | Bramsen et al. | 91/45 |
| 2,728,238 | 12/1955 | Paasche | 74/99 |
| 3,169,706 | 2/1965 | Ross | 239/186 |
| 3,443,993 | 5/1969 | Lynn et al. | 134/123 |
| 3,516,849 | 6/1970 | Shank, Jr. et al. | 117/94 |
| 3,545,459 | 12/1970 | Phillips | 134/123 |
| 4,096,300 | 6/1978 | William | 118/314 |
| 4,220,115 | 9/1980 | Brossman et al. | 118/314 |
| 4,516,526 | 5/1985 | Drockila | 118/323 |

*Primary Examiner*—Shrive Beck
*Attorney, Agent, or Firm*—John F. Ingman

[57] ABSTRACT

A lumber end sealing machine involves a pass-through design utilizing a single exhaust system and the use of traveling and rotating sealer paint spray guns. An exhaust chamber is centered over the conveyor with spray guns located at both the conveyor entrance and exit openings of the exhaust chamber. The spray guns are formed to both transversely and rotatingly pass through an end face of the package of lumber which is stopped at the center of the exhaust system. The spray guns are supported on a vertical rod suspended from a carriage with transverse movement through the use of a pneumatic rodless piston and rotational movement of the spray guns by rotation of the vertical rod by means of a cam follower mechanism engaged with a curved profile bar. The actual spraying of the sealer paint occurs during only a portion of the passage of the spray guns across an end face, the spraying beginning and stopping with the spray guns still located to the inside of the vertical side edges of the end face and with the spraying being directed outwardly toward the vertical side edge of the end face so as to mask the sides of the package. An alternative configuration of the invention includes fixed spray means centrally located along the sides within the exhaust chamber so as to additionally spray sealer paint inwardly on the sides of the package as it passes through the chamber.

8 Claims, 5 Drawing Sheets

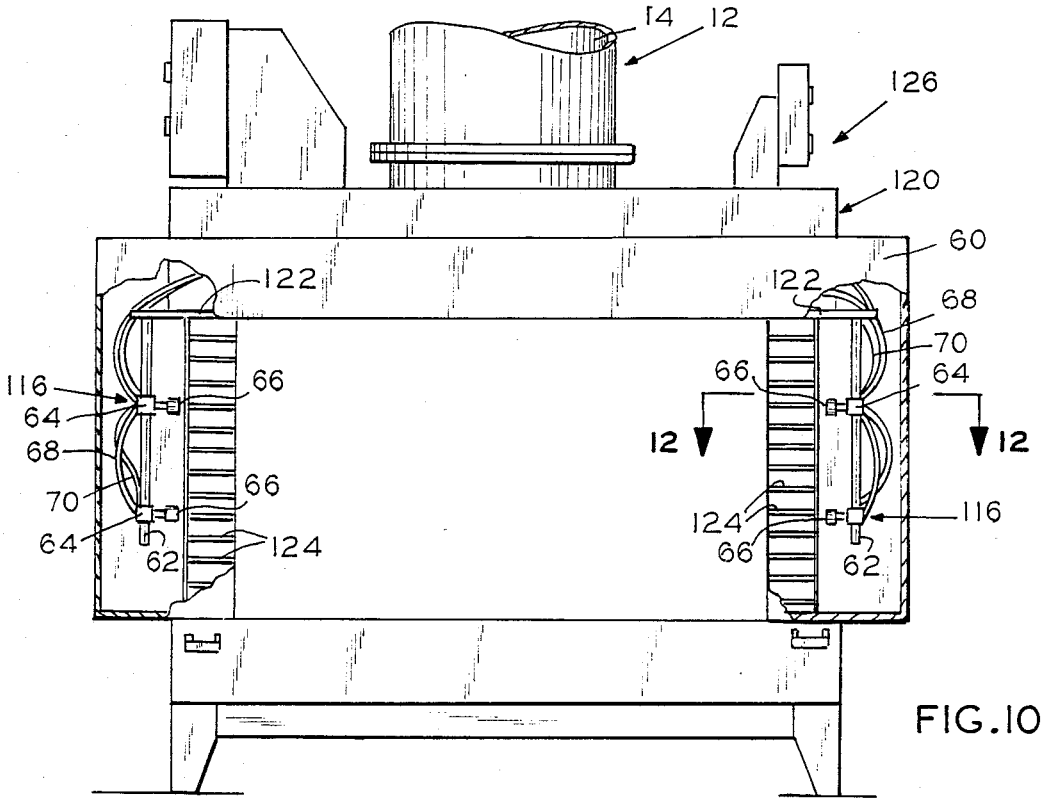
FIG. 10
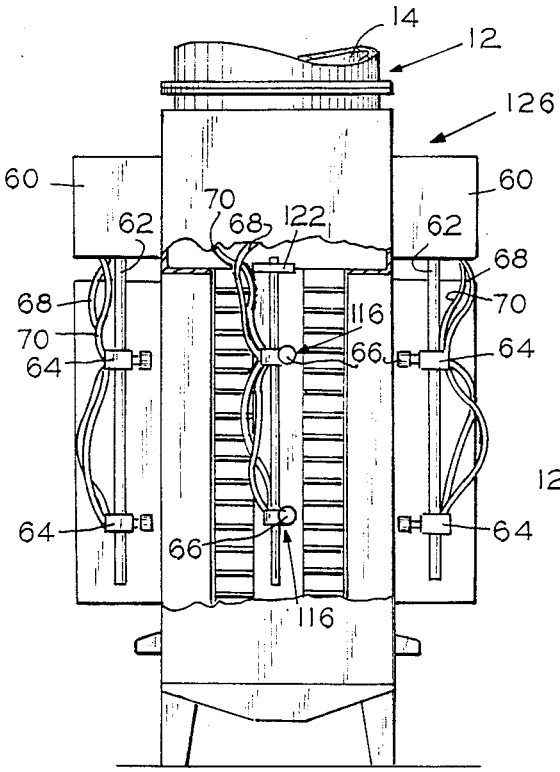
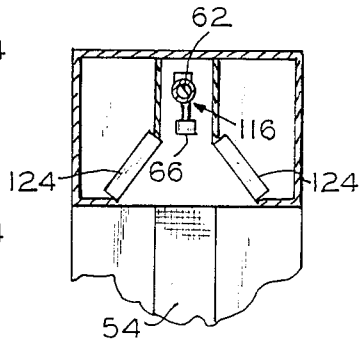
FIG. 12
FIG. 11

LUMBER END SEALING MACHINE

BACKGROUND OF THE INVENTION

1. Field of the Invention

This invention involves a sealing paint spraying machine, and, more particularly, an end sealing machine for application to packages of lumber or other wood products.

2. Description of the Prior Art

A sealing material commonly is applied to the ends of pieces of lumber at the sawmill to maintain the moisture content of the wood. The sealing generally is accomplished by spraying a high-paraffin content paint on the ends of a package of lumber which has been stacked and strapped for transportation. The normal way of spraying the sealer paint is by hand, which often results in a messy job and wasted sealer paint.

Attempts of mechanized spraying of the ends has usually resulted in two separate spraying machines, one at each end face of the package, where the sealer paint is sprayed out of an exhaust chamber onto the ends while the machine attempts to recapture wasted sealer paint or overspray. Recapture methods on such machines may include the use of doors to contain the overspray. Sealer paint is often left on the doors and then passed on to the non-end portions of subsequent packages which the doors contact. The set-up of such spraying machines is limited as to the length of the lumber packages handled, the position of at least one of the spraying machines needing to be adjusted for each different length of lumber.

Sealing also may be desirable for the sides as well as the ends of certain wood product forms, such as plywood.

What is needed, to overcome the limitations of hand-spraying and prior spraying machines is an end sealing machine which:

a. sprays into an exhaust area;

b. utilizes only a single exhaust area for sealing both ends of the packaged lumber;

c. utilizes spraying means which evenly and effectively cover the ends of each piece of lumber in a package with a minimum of waste and without unintentionally applying sealer paint to the lumber or package other than on the ends thereof;

d. operates in conjunction with a normal sawmill conveyor system;

e. can be utilized with any length of lumber without repositioning the spraying means;

f. is adaptable to automated operation; and g. is adaptable to incorporated additional spraying means for the sealing of the sides, as well as the ends, of packages of certain wood products, such as plywood.

SUMMARY OF THE INVENTION

The present invention provides an lumber end sealing machine designed to satisfy the aforementioned needs. The invention involves a pass-through design utilizing a single spraying machine and exhaust system, and non-contact masking of the end of a lumber package through the use of traveling and rotating sealer paint spray guns.

Accordingly, the invention, in its preferred embodiment, comprises, in combination with a conveyor transporting longitudinally oriented packages of lumber so that the leading and trailing end faces of a package of lumber represents the ends of pieces of lumber to be sealed, a single exhaust system having its exhaust chamber centered over the conveyor with sealer paint spray means located at both the conveyor entrance and exit openings of the exhaust chamber. The sealer paint spray means are formed to both transversely and rotatingly pass across an end face of the package of lumber which is stopped at the center of the exhaust system. Utilizing spray guns supported on a vertical rod suspended from a carriage, the preferred means of transverse passage of the carriage, and thus the spray guns, is through use of a pnuematic rodless piston. Rotational passage of the spray gun is preferably accomplished by rotation of the vertical rod by means of a cam follower mechanism engaged with a curved profile bar. The actual spraying of the sealer paint occurs during only a portion of the passage of the spray guns across an end face. The spray guns initially move transversely without spraying onto the end face of the package of lumber; the spraying commences when the spray guns are located to the inside of the vertical edge of the end face of the package of lumber, and the spraying is directed outwardly toward the vertical edge of the end face; the spraying continues with further transverse movement of the spray guns, and further rotation of the spray guns, until the spray strikes the opposing vertical edge of the end face, whereat the spray terminates with the spray gun still to the inside of the opposing vertical edge of the end face; the spray guns continue transverse movement without spraying until they are outside of the opposing vertical edge of the end face and out of the way. The spraying outwards, toward the vertical edges of an end face from inside those edges, allows the vertical edge itself to mask the side of the package of lumber so as to preclude sealer paint from being applied thereon.

The method of end sealing of packages of lumber being transported by conveyor means includes the following steps:

a. Detecting the leading end face of the package of lumber proceeding on the conveyor;

b. Stopping the package of lumber on the conveyor so that its leading end face halts substantially at the center of an exhaust chamber;

c. Initiating movement of a sealer paint spraying apparatus, including spray guns, transversely across the end face of the package in the exhaust chamber;

d. Initiating spraying of sealer paint upon the end face of the lumber package as the spray guns of the first spraying apparatus pass a first vertical side edge thereof, with the spray guns located to the inside of the vertical side edge of the end face, and the spray directed outwardly against that vertical side edge;

e. Continuing transverse movement of the spraying apparatus across the end face and concurrently rotating the spray guns so that the spray passes through a perpendicular orientation to said end face;

f. Terminating the spraying of sealer paint when the spray of the rotating spray guns reaches the second, and opposing, vertical side edge of the end face, the spray guns still being inside the second vertical side edge of the end face;

g. Continung transverse movement of the spraying apparatus until the spray guns clear to the outside of the second vertical side edge of the end face;

h. Starting the conveyor and moving the package of lumber through the exhaust chamber;

i. Detecting the trailing face of the package of lumber proceeding on the conveyor;

j. Stopping the package of lumber so that its trailing face halts at substantially the center of the exhaust chamber;

k. Repeating steps 'c' through 'g' with a second sealing paint spraying apparatus; and l. Starting the conveyor and moving the end-sealed package of lumber out of the exhaust chamber and on down the conveyor.

With certain wood products, such as packages of plywood, it is desirable to seal all edges, including the sides as well as the ends, with sealer paint. An alternative configuration of the invention may be used which additonally includes fixed spray means centrally located along the sides within the exhaust chamber so as to spray sealer paint inwardly as the package on the conveyor moves from the leading face sealing position to the trailing face sealing position. The side spray guns during such movement thus additionally provide sealer paint to the sides of the wood products in the packages.

BRIEF DESCRIPTION OF THE DRAWINGS

FIG. 10 provides a front elevation view of an alternative configuration of the lumber end sealing machine, with portions broken away to show fixed side spray guns installed for spraying of sealer paint on the sides of a package of lumber.

FIG. 11 provides a partial section side view of the alternative configuration of FIG. 10.

FIG. 12 provides a partial section of the alternative configuration of FIG. 10, as seen at 12—12 of FIG. 10.

DESCRIPTION OF THE PREFERRED EMBODIMENT

Figure 1:
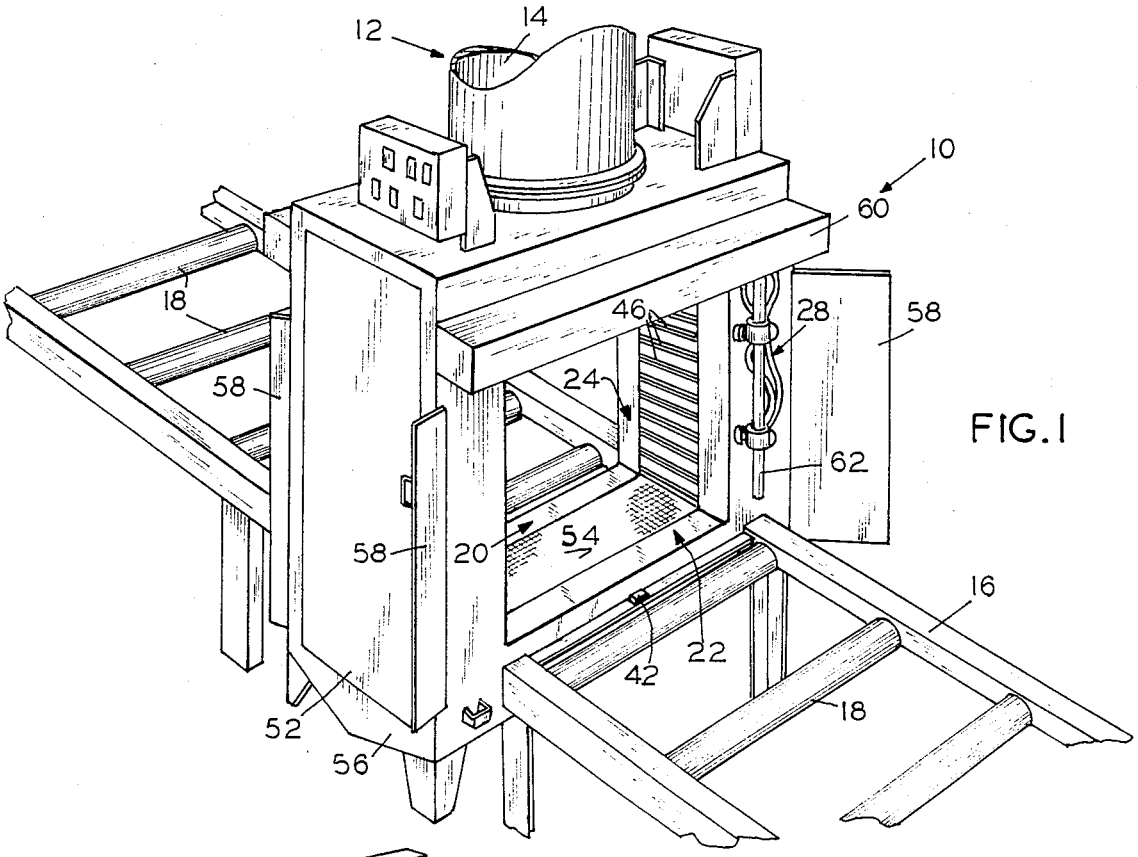
FIG. 1 provides a perspective view of the preferred embodiment of the lumber end sealing machine.

Referring now to the drawings, a preferred embodiment of the lumber end sealing machine 10 is shown. An exhaust system 12, utilizing a single exhaust stack 14, straddles a conventional conveyor 16, with rollers 18, as illustrated. The exhaust chamber 20 has two openings, an entrance opening 22 and an exit opening 24, permitting a package of lumber 26 to pass through the exhaust chamber 20 on the conveyor 16 in a tunnel-like manner. A separate set of spraying apparatus 28 is located adjacent to each of the exhaust chamber 20 openings 22 and 24 so as to spray sealer paint 30 into the exhaust chamber 20, in a manner that is described subsequently.

Figure 2:
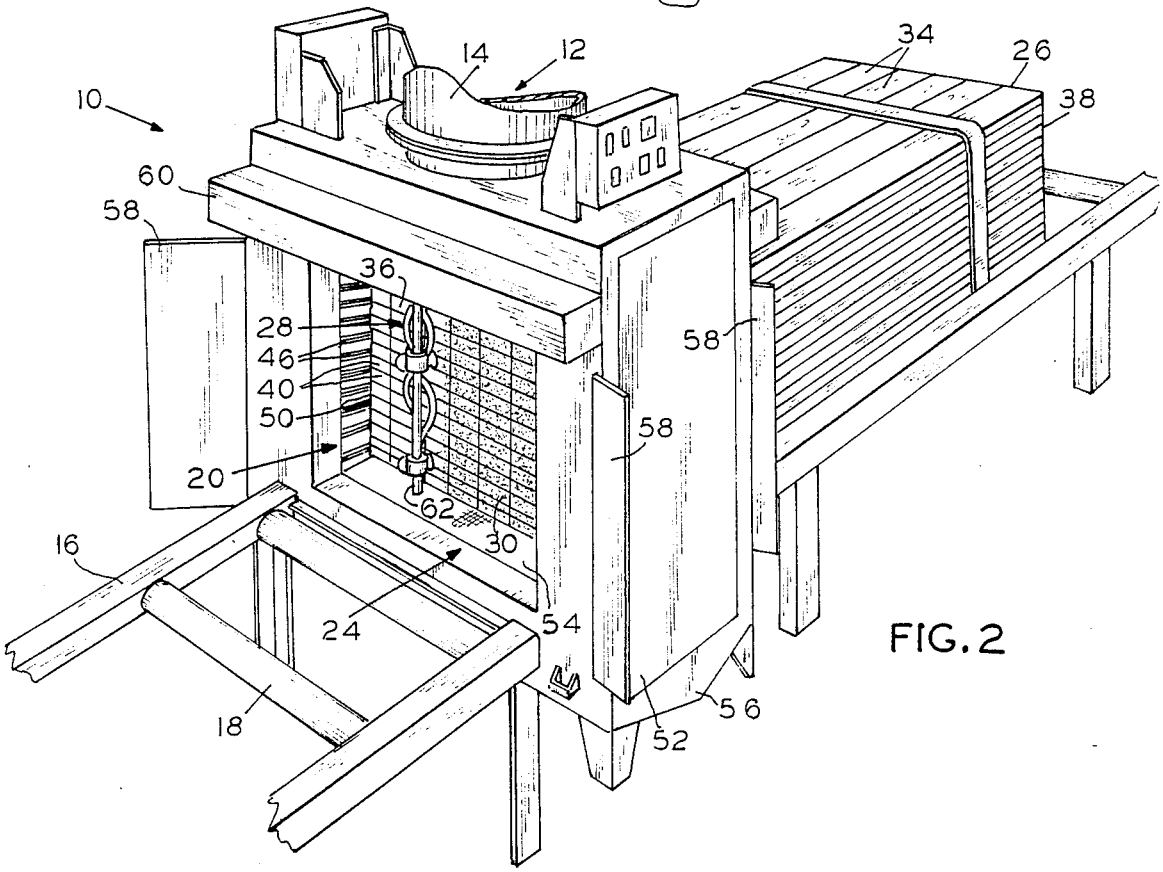
FIG. 2 provides of the lumber end sealing machine of FIG. 1, where sealer paint is being applied to an end face of a package of lumber.
Figure 3:
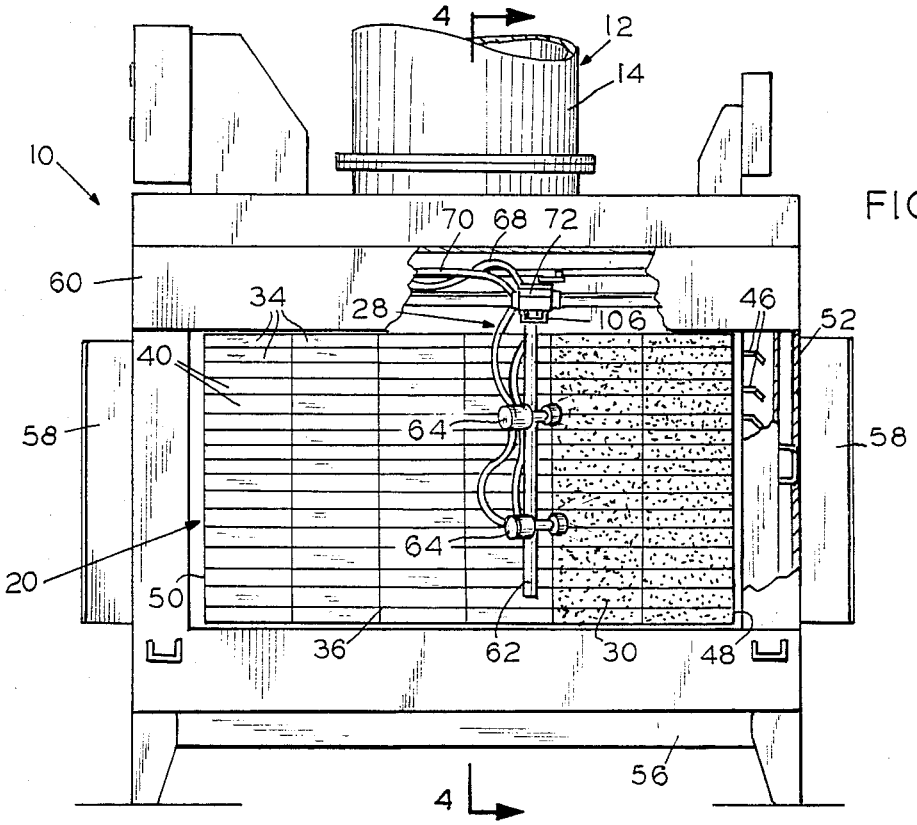
FIG. 3 provides a partially sectioned end view of the lumber end sealing machine of FIG. 2

FIG. 2 illustrates the end sealing machine 10 in use while end sealing a package of lumber 26 which has advanced through the entrance opening 22. The package of lumber 26 is made up of multiple individual pieces of lumber 34, stacked and packaged together, and longitudinally oriented on the conveyor 16 so that the leading face 36 and the trailing face 38 of the packages of lumber 26 are composed of the ends 40 of the individual pieces of lumber 34 to be sprayed and sealed.

Means of detection of the presence or absence of a package of lumber 26 are provided in proximity to the entrance opening 22. A single-unit photocell detector 42 is preferred, although a mechanical-switch type of detector also is suitable. Upon detection of the package of lumber 26, that is, as the leading face 36 passes the detector 42, the movement of the conveyor 16 is halted so that the leading face 36 stops substantially at the center of the exhaust chamber 20, where it will be sprayed. The halting of the conveyor 16 due to the detection of the leading face 36 passing by the detector 42 can be accomplished in a number of ways, as appreciated by those skilled in this matter, e.g., by use of a pulse counter (not shown) or other device which allows a specific distance of conveyor 16 movement before disconnecting motive power to the conveyor 16.

The spraying apparatus 28, which is of use in the spraying of the leading face 36 of the package of lumber 26, as shown in FIG. 2, is that spraying apparatus 28 located adjacent to the exit opening 24 of the exhaust chamber 20, while the spraying apparatus 28 which is located adjacent to the entrance opening 22 is used in spraying the trailing face 38 of the lumber package 26.

Figure 4:
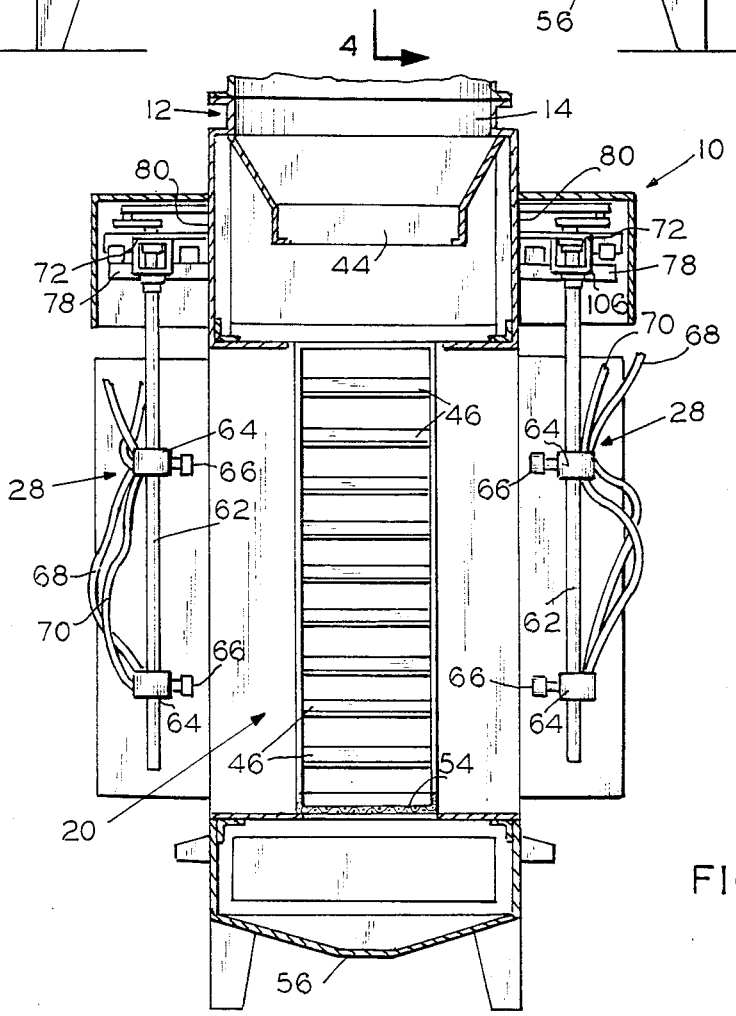
FIG. 4 provides a side view cross section, as seen at 4—4 of FIG. 3, with the lumber removed for clarity.
Figure 5:
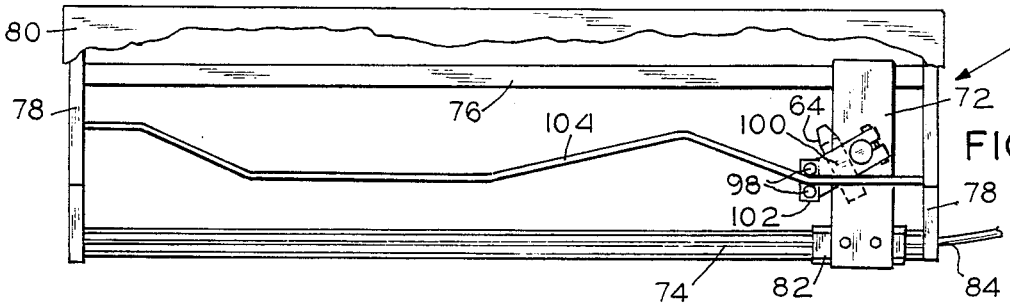
FIG. 5 provides a top view of the spraying apparatus including a pneumatically operated carriage for transverse movement and a cam follower machanism with profile bar for rotational movement.
Figure 6:
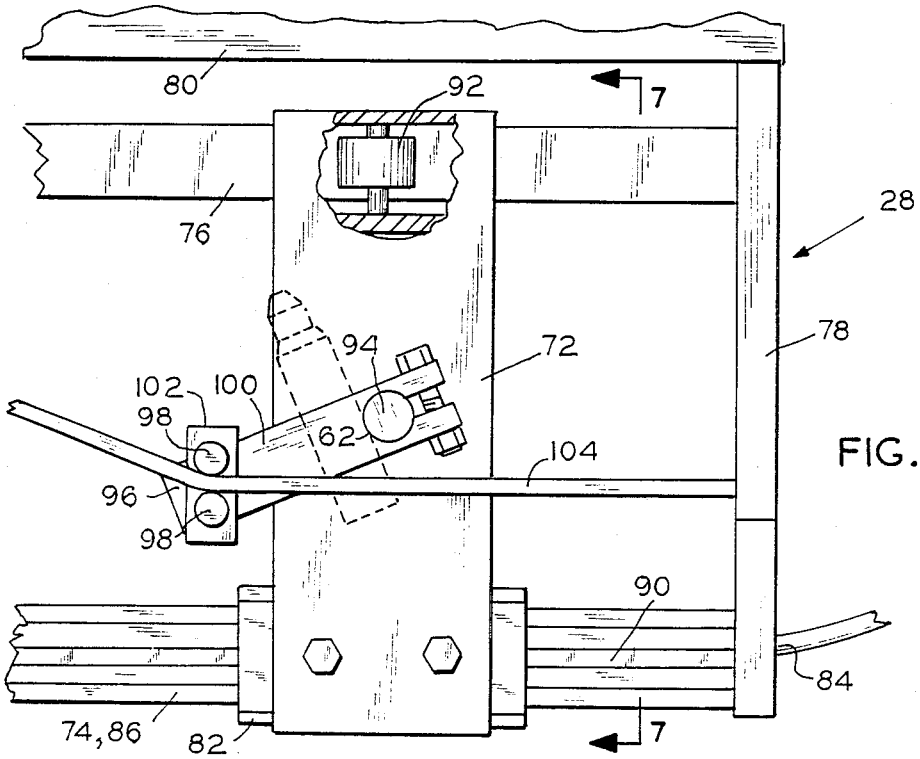
FIG. 6 provides an enlarged top view of the spraying apparatus of FIG. 5.
Figure 7:
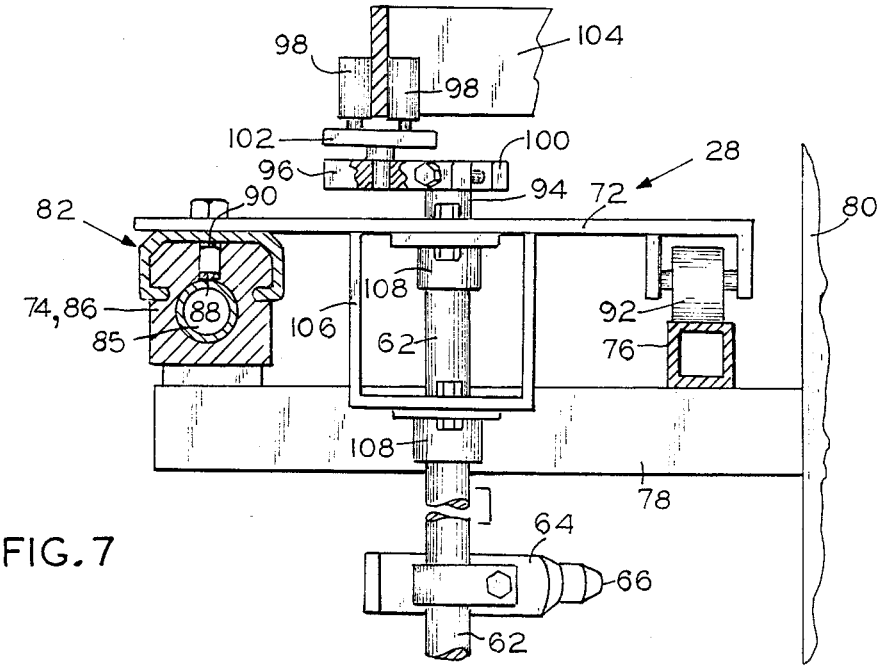
FIG. 7 provides a cross sectional view of the spraying apparatus as seen at 7—7 of FIG. 6.

The exhaust system 12 itself is best viewed in FIG. 4, a side view cross section. A single exhaust stack 14 emanates from an intake throat 44, which is centrally located above, and extends into, the single exhaust chamber 20. Low pressure to create the exhaust action is created by conventional means (not shown), such as an exhaust fan located further along the exhaust stack 14. Within the exhaust chamber 20, along its sides, a vertical series of louvers 46 are arranged so as to intercept and direct downwards for collection any sealer paint which passes the edges 48 or 50 of the end faces 36 or 38 during the spraying operation described subsequently. The louvers 46 are removable for cleaning through a louver access door 52. A screen 54 is located on the floor of the exhaust chamber 20, while a catch basin 56 at the bottom of the exhaust chamber 20 collects misdirected sealer paint for reuse. Side shields 58 extending pivotably outwards provide additional paint overspray shielding to the side, and with a top shield 60, serve to protect the mechanism of the spraying apparatus 28.

As best seen in the drawings, the spraying apparatus 28 includes a vertical rod 62 which supports one or more spray guns 64. The number of spray guns 64 supported by the vertical rod 62 will depend upon the dispersion of the spray as well as theheight of the package of lumber 26. Two spray guns 64 are illustrated in the drawings and are preferred for general use with packages of lumber 26 having a height of approximately two feet. A preferred type of spray gun 64 utilizes an airless spray nozzle 66 with a sealer paint supply hose 68 and an air supply hose 70 connected thereto.

The spraying apparatus 28 is designed to provide the sealer paint 30 to the ends 40 of the individual pieces of lumber 34 at the leading face 36 or the trailing face 38 of the package of lumber 26 in a single pass of the spray guns 64. The spray guns 64 proceed across the openings 22 and 24 of the exhaust chamber 20 with both a transverse motion and a rotational motion. The transverse motion is achieved by the movement of a carriage 72 along rails 74 and 76, from which carriage 72 the vertical rod 62 with spray guns 64 is suspended. Rails 74 and 76 may be supported by brackets 78 extending from the upper structure 80 of the exhaust chamber 20 above the openings 22 and 24. Desired movement of the carriage 72 may be obtained in different manners, e.g. electrically powered as with an electric motor and gear or chain arrangement (not shown), or pneumatically. For general application a commercially available pnuematic rodless piston apparatus 82 is preferred, wherein the application of air pressure at either end 84 of a hollow tube 86, which may also be the rail 74, will conventionally and accurately impel the rodless piston 85 within the tube 86, which has longitudinal seals 88 and 90, thereby moving the attached carriage 72 and vertical rod 62 with spray guns 64 along the supporting rail 74. A pneumatic rodless piston apparatus 82, as manufactured by Tol-O-Matic, Inc., Minneapolis, Minnesota, has provided excellent results. Should climatic temperature variations discourage the use of pneumatics, an electric-mechanical drive (not shown) may be desired. A support roller 92, moving on a rail 76, provides additional support for the carriage 72.

Figure 8:
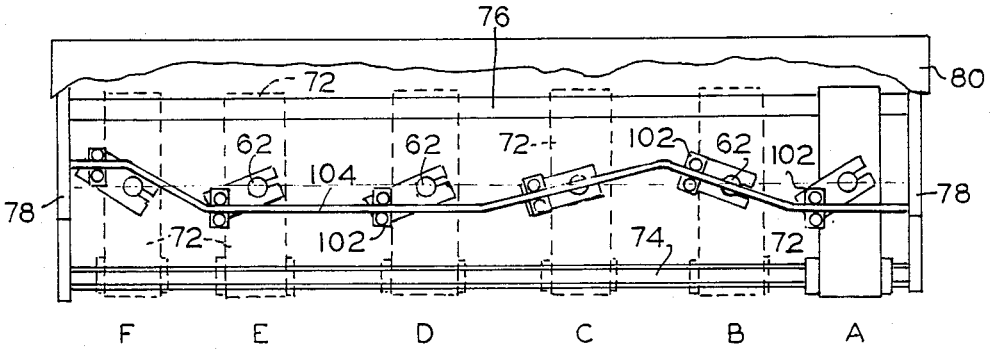
FIG. 8 provides a diagrammatic top view of the spraying apparatus, similar to FIG. 5 but illustrating a number of transverse spraying positions.
Figure 9:
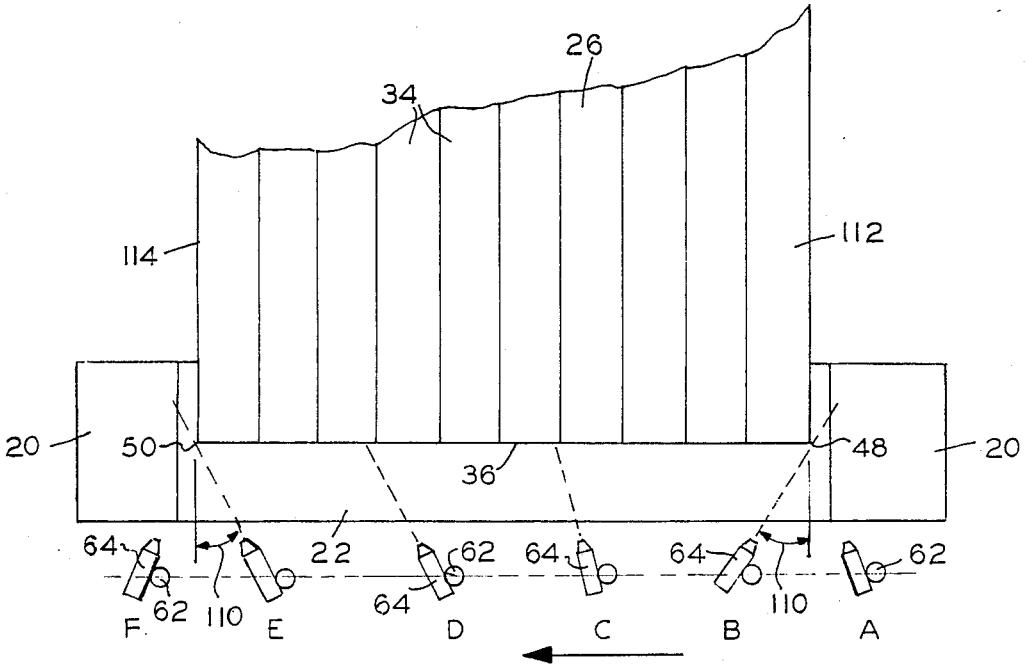
FIG. 9 provides a diagrammatic top view of the vertical rod and attached spray guns, illustrating various orientations of the spray guns corresponding to the transverse positions of the carriage as illustrated in FIG. 8.

The rotation of the spray guns 64 occurs simultaneously with the movement across the openings 22 and 24 of the exhaust chamber 20, and is created by the rotation of the vertical rod 62 about its longitudinal axis. The upper end 94 of the vertical rod 62 is rotatingly supported by a yoke 106 and bearings 108 at the carriage 72 and adjustably attached, as by clamp 100, to a cam follower 96 having two vertical fingers 98 on a rotating base 102. The fingers 98 abut on both sides of a profile bar 104 extending across the upper portion of the opening 22 or 24 adjacent to the rail 74 and in the same horizontal plane as the vertical fingers 98 of the cam follower 96. As best seen in FIGS. 8 and 9, as the carriage 72 proceeds to different positions along the rail 74, the cam follower 96 will, by its vertical fingers 98 follow the profile bar 104, thus rotating its position and the position of the attached vertical rod 62 and spray guns 64. While other means of rotation of the spray guns 64 may be achievable, the combination of the cam follower 96 and profile bar 104 is simple and preferred.

The actual spraying of the sealer paint 30 occurs during only a portion of the passage of the spray guns 64 across an end face 36 or 38 of the package of lumber 26. FIGS. 8 and 9 illustrate diagrammatically a sequence of six positions, moving from right to left and identified respectively as A, B, C, D, E, and F. The spray guns 64, initially at position A, move transversely without spraying, until the spray guns 64 are located at position B to the inside of the vertical edge 48 of the end face 36 or 38 and are rotationally oriented outwards towards that vertical edge 48 at an angle 110 of approximately thirty degrees. At position B, spraying commences on the entire height of the package 26, the vertical edge 48 masking the side 112 of the package 26 so that the side 112 remains free of sealer paint. The spraying continues with additional transverse movement of the spray guns 64 on the vertical rod 62 attached to the carriage 72, and rotational movement of the spray guns 64 towards the end face 36 or 38 as the vertical rod 62 rotates due to the action of the cam follower 96 on the profile bar 104.

The shape of the profile bar 104 accomodates the desired rotation of the spray guns 64 as they move transversely across the face 36 or 38. In addition to providing that the orientation of the spray guns 64 is outwards to provide vertical edge masking at along the the sides 112 or 114 of the package of lumber 26, it is also desirable to present such outwards orentation (e.g., at angle 110) for an extended transverse distance, thereby providing an ability to seal various widths of package 26 without adjustment. The drawings illustrate a preferred configuration of profile bar 104 although other shapes could also work.

When the transverse movement reaches position C, the rotation of the spray guns 64 is past a perpendicular orientation to the end face 36 or 38 so that the spray now is directed slightly to the left, as illustrated. With movement continuing, as the spray guns 64 pass position C, the rotation of the spray guns 64 continues in the direction of transverse movement until the spray is oriented to the left at the desired angle 110, approximately thirty degrees. Such orientation continues beyond position D until position E, where the spray guns 64 spray the opposing vertical edge 50 with the spray guns 64 still located to the inside of the opposing vertical edge 50, which maskes the side 114 of the package. At this point, position E, the actual spraying terminates, but the spray guns 64 continue to move transversly until outside of the opposing vertical edge 50, that is to position F, out of the way of movement of the package 26 aboard the conveyor 16. The rotational orientation of the spray guns 64 at positions A and F is a matter of choice, and design of the profile bar 104, they being illustrated as angled inwards towards the exhaust chamber 20 in case of accidental spraying.

A method of end sealing of packages of lumber being transported by conveyor means is provided which includes the following steos, with reference to the drawings, and discussion on the means of control involved:

a. Detecting the leading end face 36 of the package of lumber 26 proceeding on the conveyor 16. Such detection may be visually by the operator or by use of a detection device, such as a photo-cell 42 or a microswitch (not shown) installed at the entrance opening 22 of the exhaust chamber 20.

b. Stopping the package of lumber 26 so that its leading end face 36 halts substantially at the center of the exhaust chamber 20. This step may be performed manually, as by interrupting power to the conveyor 16, or may occur automatically in conjunction with the detection device, wherein movement of the conveyor 16 is subsequently halted, such as after certain rotoation of a roller 18 of the conveyor 16.

c. Initiating movement of a first sealing paint spraying apparatus 28, which includes spray guns 64 and is located at the exit opening 24 of the exhaust chamber 20, transversely across the leading end face 36 of the package 26 located within the exhaust chamber 20. Initiating such movement may be completed manually by an operator or may occur automatically upon the stoppage of the end face 36 within the exhaust chamber 20. In the preferred embodiment described above, the transverse movement of the spray guns is pneumatically impelled, requiring an air source and suitable controls, as are well known within the art.

d. Initiating spraying of sealer paint 30 upon the leading end face 36 of the lumber package 26 by the spray guns 64 of the first spraying apparatus 28, with the spray guns 64 located to the inside of the vertical side edge 48 of the end face 36, and the spray directed outwardly against the vertical side edge 48 of that face 36. Since the sealer paint spray guns 64 are air-operated, such initiation of spraying is easily established within pneumatic controls upon pre-established transverse movement of a pneumatic rodless piston apparatus 82.

e. Continuing transverse movement of the first spraying apparatus 28 and concurrently rotating the spray guns 64 so that the spray passes through a perpendicular orientation to the end face 36. Since the rotation of the spray guns 64 in the preferred embodiment is mechanical and automatic with their transverse movement, no further control is required for this step.

f. Terminating the spraying of sealer paint 30 when the spray of the rotating spray guns 64 reaches the opposing vertical side edge 50 of the face 36, the spraying guns 64 still being located to the inside of the opposing vertical side edge 50 of the face 36, and the spray being directed outwards against the opposing vertical side edge 50. As in step 'd', the termination of the sealer paint spraying can be either manual or automatic, with automatic means preferred.

g. Continuing transverse movement of the spraying apparatus 28 until the spray guns 64 clear to the outside of the opposing vertical side edge 50 of the face 36. The halting of transverse movement of the spray guns 64 may be manual, but preferably is automatic within the pneumatic controls.

h. Starting the conveyor 16 for moving the package of lumber 26 through the exhaust system 12. Further movement of the conveyor 16 and package of lumber 26 clearly may either be manual or automatic upon completion of the spraying of the leading face 36.

i. Detecting the trailing face 38 of the package of lumber 26 proceeding on the conveyor 16. As in step 'a', such detection may be visual or by detection device. The same detection device as used in step 'a' may also be used in this step, here the detection being the sudden absence of the package of lumber 26, i.e., the trailing face 38.

j. Stopping the package of lumber 26 so that its trailing face 38 halts at substantially the center of the exhaust chamber 20. The manner of control in stopping the conveyor after detection, as described in step 'b', also applies here.

k. Initiating movement of a second sealer paint spray apparatus 28, which includes spray guns 64 and is located at the entrance opening 22 of the exhaust chamber 20, transversely across the trailing end face 38 of the package 26 located within the exhaust chamber 20. As in step 'c', initiating such such movement may be completed manually by an operator or may occur automatically upon the stoppage of the end face 38 within the exhaust chamber 20.

l. Initiating spraying of sealer paint 30, upon the trailing end face 38 of the lumber package 26 by the spray guns 64 of the second spraying apparatus 28, with the spray guns 64 located to the to the inside of the vertical side edge 48 of the end face 38, and the spray directed outwardly against the vertical side edge 48 of that face 38. As with step 'd', such initiation is easily established within the pneumatic controls upon a pre-established transverse movement of the pneumatic rodless piston apparatus 82.

m. Continuing transverse movement of the second spraying apparatus 28 and concurrently rotating the spray guns 64 so that the spray passes through a perpendicular orientation to the end face 38. As in step 'e', no further control is required for this step.

n. Terminating the spraying of sealer paint 30 when the spray of the rotating spray guns 64 reaches the opposing vertical side edge 50 of the face 38, the spraying guns 64 still being located to the inside of the opposing vertical edge 50 of the face 38, and the spray being directed outwards toward the opposing vertical side edge 50. As in step 'f', the shutting off of the paint spray can be either manual or automatic, with automatic means preferred.

o. Continuing transverse movement of the spraying apparatus 28 until the spray guns 64 clear to the outside of the opposing vertical side edge 50 of the face 38. The halting of transverse movement of the spray guns 64 may be manual, but preferably is automatic within the pneumatic controls.

p. Starting the conveyor 16 so as to move the end-sealed package of lumber 26 out of the exhaust chamber 20 and on down the conveyor 16. The control means here may be either manual or automatic.

Clearly, from the above description of steps involved in the instant method of end sealing of packages of lumber, the control means may be completely manual, partially automatic, or completely automatic. The manner of control used is at the discretion of the user. The system of control necessary for completely automatic control is not described in detail, a variety of types of acceptable programmed controls being well-known and commercially available, as will be appreciated by those familiar with the art.

With certain wood products, such as plywood, it may be desirable to seal the sides of each piece, as well as the ends, for moisture control. An alternative configuration 126 of the basic lumber end sealing machine 10, described above, may be used which additionally sprays sealing paint on the sides of a package of such wood products which is proceeding through the end sealing process. As illustrated in FIGS. 10, 11, and 12, additional fixed-position spray guns 116 are centrally located along both sides, midway within a modified exhaust chamber 120 and facing, transverse to the movement of the conveyor 16, towards the center of the exhaust chamber 120. The fixed spray guns 116 are similar to the spray guns 64 of the spraying apparatus 28. Spray nozzles 66 are attached to a vertical rod 62 which, rather that being rotatingly suspended form a carriage 72, is fixed to a support member 122. A sealer paint supply hose 68 and an air supply hose 70 provide paint and air to the spray guns 116. The exhaust chamber 120 is widened, approximately ten-inches, to provide sufficient distance for sealer paint to disperse between the spray nozzle 66 and the side of the package passing thereby. Due to the positioning of the spray guns 116 at the sides of the exhaust chamber 120, their location would interfere with the louvers 46 of the basic end sealing machine 10. In lieu of the louvers 46, two smaller louver sections 124 are used, one each side of each spray gun 116 to intercept sprayed sealer paint which bypasses the end faces 36 and 38 during the end spraying operation. These smaller louver sections 124 are placed at approximately a 45-degrees angle to the sides of the exhaust chamber, as best seen in FIG. 12.

Upon completion of the application of spray paint on the leading end face 36, and with initiation of the forward movement of the package 26 on the conveyor 16, spraying is initiated through the two opposing fixed spray guns 116, so as to cover both sides of the package as it proceeds past the fixed spraying guns 116. Upon the trailing end face 38 reaching the center of the exhaust chamber 120 position, where the trailing end face 38 will be sealed, the spray guns 116 are turned off, the length of the sides having been completely sprayed and sealed. At this point, the trailing end face 38 of the package is sprayed, as described above. Thus, with only a minimum of changes from the basic lumber end sealing machine 10 configuration, a sealing machine 126, which seals both the sides and the ends of a package of lumber, is available with all of the advantages of the end sealing machine 10.

It is thought that the lumber end sealing machine of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A lumber end sealing machine, for application of sealing paint on the ends of packages of lumber being transported by conveyor means, comprising:

a. conveyor means for transporting longitudinally oriented packages of lumber, each said package of lumber having a leading end face corresponding to ends of contained individual pieces of lumber, and a trailing end face corresponding to the opposing ends of the contained individual pieces of lumber;

b. a single exhaust system, having an exhaust chamber centered over the conveyor means; the exhaust chamber having two conveyor means openings, a conveyor entrance opening and a conveyor exit opening;

c. a first sealer paint spraying means located at the conveyor exit opening of the exhaust chamber and a second sealer paint spraying means located at the conveyor entrance opening of the exhaust chamber;

(1) said first sealer paint spraying means formed to spray sealer paint upon the leading end face of the package of lumber being transported on the conveyor with the leading end face being halted at substantially the center of the exhaust chamber;

(2) said second sealer paint spraying means formed to spray sealer paint upon the trailing end face of a package of lumber being transported on the conveyor with the trailing end face being halted at substantially the center of the exhaust chamber;

(3) said first and second sealer paint spraying means being formed to deliver sealer paint spray while engaged in both transverse and rotational movement across the leading end face and trailing end face, respectively, of the package of lumber: said spraying means initially moving transversely past a first vertical side edge of the end face without spraying onto the end face of the lumber package; said spraying means commencing spraying when located to the inside of said first vertical side edge of the end face and spraying outwardly towards said vertical side edge of the end face of the lumber package; said spraying means continuing transverse movement across the end face while concurrently rotating so that the spraying means pass a position of spraying perpendicular to the end face; said spraying means continuing movement across the end face while concurrently continuing rotation, and terminating spraying when the spraying means are inside a second and opposing vertical side edge of said end face and directed outwardly towards said second and opposing vertical side edge of the end face of the package of lumber; said spraying means continuing its transverse movement, without further spraying, to a position outside of the path of the package of lumber on the conveyor means;

(4) means for transverse movement of the sealer paint spraying means;

(5) means for rotational movement of the sealer paint spraying means.

2. A lumber end sealing machine, as recited in claim 1, wherein, additionally, there are position sensing means for detecting the leading end face of the package of lumber and means for stopping the conveyor means so that the leading end face is located substantially at the center of the exhaust chamber, and position sensing means for detecting the trailing end face of the package of lumber and means for stopping the conveyor so that the trailing end face is located substantially at the center of the exhaust chamber.

3. A lumber end sealing machine, as recited in claim 1, wherein the sealing paint spraying means comprise one or more spray guns attached along a vertical rod, the vertical rod being rotatably supported by a transversely movable carriage member mounted above the conveyor entrance opening and above the conveyor exit opening.

4. A lumber end sealing machine, as recited in claim 3, wherein the means for transverse movement of the spray guns is through a pneumatic rodless piston operating within a cylinder extending transversely across the conveyor entrance opening and across the conveyor exit opening, and which is connected to said carriage member supporting said vertical rod and spray guns.

5. A lumber end sealing machine, as recited in claim 3, wherein the means for rotational movement of the spray guns includes a cam follower member attached to the vertical rod supporting said spray guns, which cam follower member engages a curved profile bar so that, during transverse movement of the carriage member, the cam follower member follows the curved profile bar and thereby varies the rotational orientation of the vertical rod about its longitudinal axis, and the rotational orientation of the attached spray guns accordingly.

6. A lumber sealing machine, as recited in claim 1, wherein, additionally, there are:

a. a third sealer paint spraying means located within the exhaust chamber and centered along a longitudinal side, with said third spraying means formed to spray sealer paint transversely inward upon a side face of the package of lumber being transported by the conveyor means; and b. a fourth sealer paint spraying means, also located within the exhaust chamber and centered along the longitudinal side opposing the location of said third spraying means, with said fourth spraying means formed to spray sealer paint transversely inward upon the side face opposing the side face of the package of lumber being sprayed by said third spraying means;

c. wherein, upon completion by the first sealer paint spraying means of spraying sealing paint upon the leading end face of the package of lumber with the leading end face being halted at substantially the center of the exhaust chamber, and during a further movement of the package of lumber on said conveyor means to a position where the trailing end face is located substantially at the center of the exhaust chamber, the third and fourth sealer paint spraying means spray sealer paint transversely and inwardly upon the side faces of the package of lumber.

7. A method of end sealing of packages of lumber being transported by conveyor means, comprising the following steps:

a. Detecting the leading end face of the package of lumber proceeding on the conveyor means;

b. Stopping the package of lumber so that its leading end face halts substantially at the center of an exhaust chamber;

c. Initiating movement of a sealer paint spraying means, including spraying guns, transversely across the end face in the exhaust chamber;

d. Initiating spraying of sealer paint upon the end face in the exhaust chamber as the spray guns of the spraying means pass a first vertical side edge thereof, with the spray guns located to the inside of the first vertical side edge of the end face, and the spray directed outwardly against said first vertical side edge;

e. Continuing transverse movement of the spraying means across the end face and concurrently rotating the spray guns so that the spray passes through a perpendicular orientation to said end face;

f. Terminating the spraying of sealer paint when the spray of the spray guns reaches a second, and opposing, vertical side edge of the end face, the spray guns still being inside the second and opposing vertical side edge of the end face, and the spray being directed outwardly against said second and opposing vertical side edge of the end face of the package of lumber in the exhaust chamber;

g. Continuing transverse movement of the sealer paint spraying means until the spray guns clear to the outside of the second and opposing vertical side edge of the end face in the exhaust chamber;

h. Starting the conveyor for continuation of movement of the package of lumber through the exhaust chamber;

i. Detecting the trailing end face of the package of lumber proceeding on the conveyor;

j. Stopping the package of lumber so that its trailing end face halts at substantially the center of the exhaust system;

k. Repeating steps 'c' through 'g' with a second sealing paint spraying means; and m. Starting the conveyor so as to move the end-sealed package of lumber out of the exhaust chamber and on down the conveyor.

8. The method of end sealing of packages of lumber being transported by conveyor means, as recited in claim 7, where the following additional step is inserted between step 'h' and step 'i': initiating spraying of sealer paint upon the sides of the package of lumber between said leading end face and said trailing send face by fixed spraying means located within the exhaust chamber and centered along opposing longitudinal sides of the exhaust chamber so as to spray transversely and inwardly upon the sides of the package of lumber while moving within the exhaust chamber.

* * * * *